US005415580A

United States Patent [19]

Ferri

[11] Patent Number: 5,415,580

[45] Date of Patent: May 16, 1995

[54] VARIABLE HEIGHT DOUBLE-FACED DOLL, ADAPTABLE TO THE BODY AND HEIGHT OF THE USER

[75] Inventor: Jaime Ferri, Onil, Spain

[73] Assignee: Onilco Innovacion S.A., Onil, Spain

[21] Appl. No.: 192,666

[22] Filed: Feb. 7, 1994

[30] Foreign Application Priority Data

Jul. 19, 1993 [ES] Spain ..... 9302024 U

[51] Int. Cl.[6] ..... A63H 3/36; A63H 3/02

[52] U.S. Cl. ..... 446/320; 446/390

[58] Field of Search ..... 446/320, 321, 369, 390

[56] References Cited

U.S. PATENT DOCUMENTS

| | | | |
|---|---|---|---|
| 2,754,121 | 7/1956 | Jupiter | 446/327 X |
| 3,645,038 | 2/1973 | Morrison et al. | 446/390 X |
| 4,259,807 | 4/1981 | Silverstein | 446/320 |
| 4,373,292 | 2/1983 | Pelura | 446/321 X |

FOREIGN PATENT DOCUMENTS

| | | | |
|---|---|---|---|
| 2610531 | 8/1988 | France | 446/320 |

*Primary Examiner*—Mickey Yu

*Attorney, Agent, or Firm*—Knobbe, martens, Olson & Bear

[57] ABSTRACT

A variable height double-faced doll, adaptable to the body and height of the user. The doll is made up of a body like those of ragdolls, with its corresponding limbs, lower and upper, being soft, as well as the head. Both the lower and upper limbs are made of elastics concertinered at the seams on the arms and legs to make stretching possible for their adaptation to the height and contours of the user. The head has two faces, one on each side, which consist of hair and of a cap which are placed in such a way that they will complement each other in a different way on each respective face, depending which side is viewed. The widened parts that form the feet are endowed with a lower covering with two distinct parts on either side of a lower transverse fixing strap, so that each part of the covering is separable from the foot in order to form an opening for the positioning of the user's foot.

9 Claims, 1 Drawing Sheet

VARIABLE HEIGHT DOUBLE-FACED DOLL, ADAPTABLE TO THE BODY AND HEIGHT OF THE USER

FIELD OF THE INVENTION

The present invention refers to a variable height double-faced doll which is adaptable to the body and height of the user.

BACKGROUND OF THE INVENTION

There is a need to provide the public in general children in particular, with a new doll which, on the one hand, can assume the height of the user and, on the other hand, having two faces, can be two dolls in one.

SUMMARY OF THE INVENTION

To be more specific, the present invention comprises a doll with the peculiarity of having both the legs and the arms formed of a material which, combined with elastic elements, rubber and such, permits them to extend and/or contract in order to obtain the desired length to fit the height and dimensions of the user.

The body will be made of an appropriate material and its form will be such that there will be no difference between what we might normally consider as the front and the back, because both sides, owing to the fact that each of them has a face, are front sides. The present invention possesses the distinction that the head is dressed with the hair and a cap arranged in such a way that when the doll is observed from one side, for example, you can see a face with the hair covered by the cap. Conversely, when the doll is observed from the other side, you can see a face with the hair uncovered, even though the doll is wearing the cap on the back of its head.

The lower part or feet include a covering heel in place by a central and transversal strap, so that this covering is separated from the lower edge of that part which constitutes the foot. The covering thus forms an opening underneath on each side which will enable the child to partially introduce his foot from one side and to step on the part of the covering corresponding to that side. This serves the double purpose of, on the one hand, making possible the extension of the doll's legs by the stretching of its body upwards and, on the other hand, attaching the doll to the child. To make the attachment complete, the arms of the doll can be adapted around the child's arms to be fixed in place with velcro or some other conventional attaching device.

The two parts of the envisioned foot covering will also be fixed in place with an adhesive attachment similar to that mentioned above.

BRIEF DESCRIPTION OF THE DRAWINGS

In order to facilitate the greater understanding of the characteristics of the invention, a detailed description follows based on an accompanying set of diagrams and forming an integral part of the present document. In a merely introductory and insofar undetermined fashion, the following points are presented.

Figure 1:
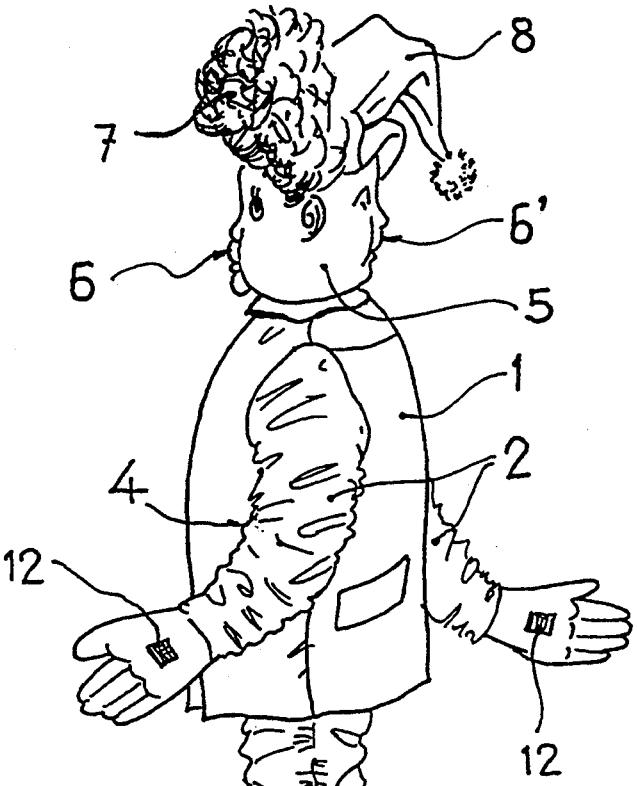
In FIG. 1 a lateral view of the doll is presented showing the double face.
Figure 2:
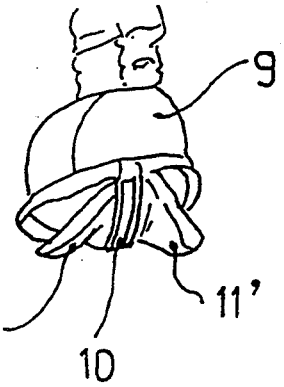
In FIG. 2 a detail of one of the feet shows the lower covering which is made up of two parts, one on either side of the central fixing strap.

In said diagrams the numeral references correspond to:

1. The body of the doll
2. The arms
3. The legs
4. The elastic parts of the arms and the legs
5. The head
6. and 6'. The faces
7. The hair
8. The cap
9. The feet
10, The strap
11, and 11'. The two-piece covering
12. The adhesive pads of the hands and the lower covering.

DETAILED DESCRIPTION OF THE PREFERRED EMBODIMENT

According to what can be observed in the said figures, the doll of the invention has a conventional body, made of an adequate and non-rigid material, such as that which is commonly known as "rag" or "cloth," endowed with an appropriate clothing, so that both sides can be seen as the front.

The legs and the arms are formed of a flexible material, and endowed with standard elastic parts, rubber or such, which will determine the gatherings of the cloth when they contract or extend. This will permit the stretching and thus the lengthening of the arms and the legs.

The head includes a double face, as well as hair, which is complemented by a cap, so that from one side a face framed with hair and a cap will appear, and from the other side just a face will appear with the cap hiding the hair.

The legs finish at the bottom in constituent enlargements for the corresponding feet, each one of these being endowed with a lower transversal strap holding in place the lower covering of two pieces, one on either side of the strap.

In accordance with the described structure, the use and the functional characteristics of the doll are as follows:

The height of the doll can be regulated and adapted to that of the child or user, which is attained by nothing more than stepping on one of the parts introducing the child's foot in the opening that is determined by the respective part. Thus, the child will be able to stretch the body of the doll upwards, extending its legs, so that the doll reaches the height of the child or whatever height the child may desire.

In the same way, the arms will be able to embrace the body of the child and adapt themselves to his size, because the arms can also be stretched.

Finally, having two faces, both sides of the doll can be used equally, always offering a frontal appearance of the doll.

The hands as well as the lower parts or coverings of the feet will be endowed with adhesive pads to fix them to the child while embracing him. There will also be adhesive pads on the closing part of the lower covering which is not being stepped on, respectively, these being the adhesive straps referred to as 12.

I claim:

1. A doll, comprising:

a cloth body having a trunk, a head, two legs, and two arms;

said head having two faces;

clothing on said body exhibiting two fronts corresponding to said two faces;

said legs and arms being flexible and having elasticity to allow stretching; and feet on said legs having two lower apertures, on each foot corresponding to said two fronts for insertion of a child's feet.

2. The doll of claim 1, wherein said arms and legs are formed by cloth gathered with the use of elastic threads.

3. The doll of claim 1, wherein said arms have hands with pads thereon for adhering to a child's hand or clothing.

4. The doll of claim 3, wherein said pads comprising one part of a hook and loop fabric fasteners for adhering to a second part of a hook and loop fabric fasteners.

5. The doll of claim 1, wherein said lower apertures on each foot are formed by a lower covering attached at the approximate midpoint on both sides of the underside of each foot to form two loose flaps, said loose flaps being securable to the bottom of each foot.

6. The doll of claim 5, further including a strap attached to an approximate midpoint on both sides of the underside of each foot and extending around exterior of said lower covering.

7. The doll of claim 5, wherein said loose flaps are secured to said foot using hook and loop fasteners.

8. The doll of claim 1, wherein said head is provided with a cap exhibiting two front views corresponding to said two faces.

9. The doll of claim 8, wherein said head includes hair arranged so that when looking at one face, both the hair and cap are visible, yet when looking at said other face, said hair substantially obscures said cap.

* * * * *